United States Patent [19]

Miller

[11] Patent Number: 4,607,702

[45] Date of Patent: Aug. 26, 1986

[54] FIRE MONITORS

[75] Inventor: Donald S. Miller, Bedford, England

[73] Assignee: The British Hydromechanics Research Association, Cranfield, England

[21] Appl. No.: 579,901

[22] PCT Filed: Apr. 26, 1983

[86] PCT No.: PCT/GB83/00122

§ 371 Date: Dec. 29, 1983

§ 102(e) Date: Dec. 29, 1983

[87] PCT Pub. No.: WO83/03768

PCT Pub. Date: Nov. 10, 1983

[30] Foreign Application Priority Data

May 4, 1982 [GB] United Kingdom ..... 8212775

[51] Int. Cl.[4] ..... A62C 27/00

[52] U.S. Cl. ..... 169/25; 239/587

[58] Field of Search ..... 169/25, 14; 239/451, 239/456, 461, 558, 565, 587

[56] References Cited

U.S. PATENT DOCUMENTS

| | | | |
|---|---|---|---|
| 422,017 | 2/1890 | Harris et al. | 169/25 X |
| 477,824 | 6/1982 | Robinson | 239/525 |
| 1,713,259 | 5/1929 | Chandler | 239/558 X |
| 1,994,389 | 3/1935 | Frisco | 239/451 X |
| 2,259,500 | 10/1941 | Thompson | 169/14 |
| 4,195,692 | 4/1980 | Dion-Biro | 169/25 |

FOREIGN PATENT DOCUMENTS

| | | |
|---|---|---|
| 1249328 | 11/1960 | France . |
| 1505721 | 3/1978 | United Kingdom . |

*Primary Examiner*—Joseph F. Peters, Jr.
*Assistant Examiner*—Daniel R. Edelbrock
*Attorney, Agent, or Firm*—Bucknam and Archer

[57] ABSTRACT

A fire monitor formed by an outer tube that communicates with a water inlet and a coaxial inner tube connected to an outlet nozzle. Water flows from the inlet into the outer tube, and then around a semitoroidal bend formed by a baffle plate and a fairing into the inner tube for discharge through the outlet nozzle. The fairing is provided on the inner surface of the inner tube and the baffle plate has a curved periphery with an inner, continuous flat surface. The semi-toroidal bend minimizes turbulence in the water flow. Swivels are provided to permit horizontal and vertical adjustment of the direction of discharged water.

3 Claims, 6 Drawing Figures

FIRE MONITORS

BACKGROUND OF INVENTION

1. Technical Field

The invention relates to fire monitors for projecting water long distances for extinguishing fires. In particular, although not exclusively, the invention relates to fire monitors to be mounted on fire-fighting vessels for use in extinguishing fires on oil-rig platforms.

2. Background of Invention

Fire monitors currently in use comprise a water conduit, inlet means connected to the water conduit, and an outlet nozzle connected to the water conduit. Maximum jet throw in fire monitors of this construction is dependent on good inlet conditions to the outlet nozzle and so it is advantageous that flow into the nozzle is free of swirl and of low turbulence level. The water conduit may therefore be provided with flow straightening vanes. However, the inlet means normally comprise bends in two planes in the form of a "ram's horn" inlet. These bends cause swirl which should be dissipated by the straightening vanes, but in practice insufficient space is available for straightening out the flow after the bends and for reducing turbulence levels. The result is poor performance in terms of water jet throw distance. Difficulty is therefore encountered when attempting to scale up existing designs of fire monitors in order to obtain the long distance water jet throw that has now become necessary.

SUMMARY OF THE INVENTION

It is therefore an object of the present invention to provide a fire monitor capable of much longer water jet throw than hitherto possible.

According to the invention, there is provided a fire monitor for projecting water, comprising a water conduit having at least two coaxially arranged tubular parts; inlet means and a coaxially extending outlet nozzle connected to the radially innermost and radially outermost tubular parts of the water conduit; and flow deflectors at axially adjacent ends of each radially adjacent pair of coaxially arranged tubular parts providing semi-toroidal bends to effect reversal of flow so that water flows along radially adjacent tubular parts in opposite directions.

A fire monitor constructed in this manner is capable of providing a high performance water jet. If the monitor is to be used with a variable water supply, it is preferred that the outlet nozzle be adjustable so that its discharge cross-section area can be varied to match the number of supply pumps connected to the fire monitor.

In order to improve the performance of the fire monitor apparatus, guide vanes may be provided between at least two radially adjacent tubular parts and the guide vanes provided in at least the tubular part connected to the outlet nozzle may be adjustable flow controlling vanes. This alllows the characteristics of the jet to be controlled by causing atomization or disruption of the water jet. The jet can thus be controlled so as to make use of environmental conditions, such as wind, which may require the jet to atomise at a particular height above sea-level so that the wind carries water droplets on to the platform of an oil-rig or on to escaping oil or gas jets. The resultant control on the size of water droplets which are deposited on the fire can be used to protect personnel or apparatus in the zone in which the water is deposited. Where structures have become heated as a result of fire, it is important to minimise the impact pressure of the water directed on to these structures in order to prevent damage to equipment.

In one simply constructed form of the apparatus according to the invention, the tubular parts of the water conduit are arranged so that the radially innermost tubular part is connected to the outlet nozzle.

Fire monitors according to the invention may also be easily installed by providing the inlet means with swivel mounting means which allow angular movements of the water conduit about at least two perpendicular axes for adjustment of the axis of the fluid conduit.

To reduce the flow loss in water flowing through the water conduit, the flow deflectors may include a baffle plate extending between each pair of radially adjacent tubular parts, and an adjacent fairing mounted on the radially inner tubular part of each pair of radially adjacent tubular parts along which the water flows in opposite directions, each baffle plate having an outer peripheral portion which is curved so as to cooperate with the adjacent fairing to provide a curved water path. However, even where swirl and turbulence have been eliminated, or at least greatly reduced, there are occasions, as hereinbefore described, when it is desirable to impose a controlled amount of turbulence to the water jet. Thus, in addition to the use of adjustable flow controlling vanes, inlet means may be provided for injecting or inducing fluid into the jet. Where this fluid is air, or some other gas, it may be used to disrupt the water jet. In other applications the fluid introduced into the jet may be a foaming agent where this is advantageous in particular fire-fighting situations.

To control the flow of water through the outlet nozzle, a centre body may be mounted within the outlet nozzle. This centre body preferably has a longitudinal axis coincident with the longitudinal axis of the water conduit and a cross-section perpendicular to its longitudinal axis, which varies at different points along its longitudinal axis. In this case, control means may be provided for varying the longitudinal position of the centre body relative to the outlet nozzle.

In one embodiment of the invention, a further conduit is mounted in the innermost tubular part of the water conduit, coaxial with the outlet nozzle; the centre body is hollow and is communicatively connected to the further conduit; a branch pipe extends between the inlet means and the further conduit; and control means are provided for controlling the flow of water through the branch pipe. This water flows out of the centre body into the water flowing through the outlet nozzle from the water conduit and therefore modifies this flow. The centre body is preferably formed with at least one outwardly directed aperture and flow of water from each such aperture atomises the water flowing through the outlet nozzle from the water conduit.

Four embodiments of the invention are hereinafter described, by way of example, with reference to the accompanying drawings in which like parts have been assigned the same reference numerals.

DESCRIPTION OF THE INVENTION

Figure 1:
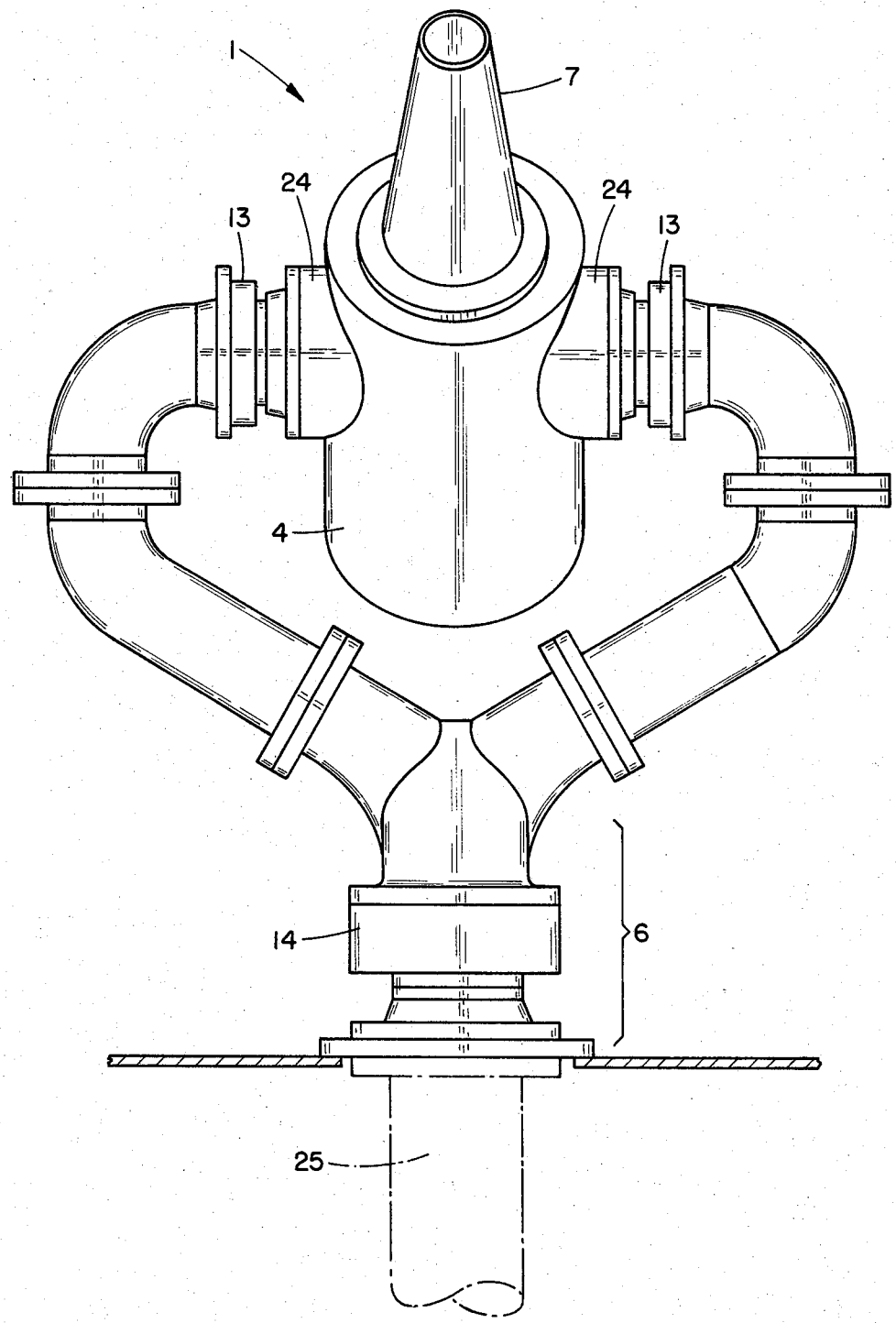
FIG. 1 is an end elevation view of a fire monitor according to the invention.
Figure 2:
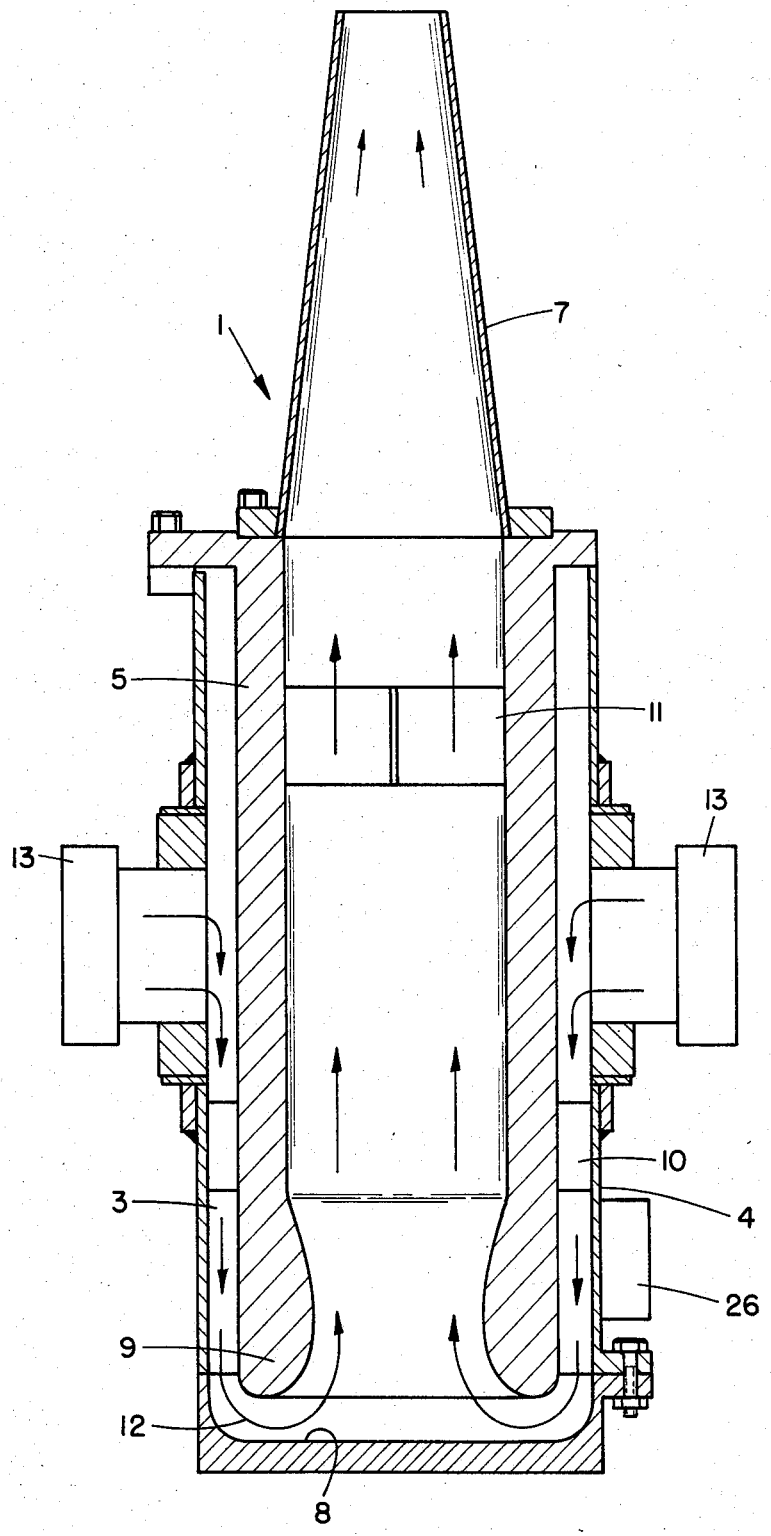
FIG. 2 is a sectional plan view of part of the apparatus shown in FIG. 1.
Figure 3:
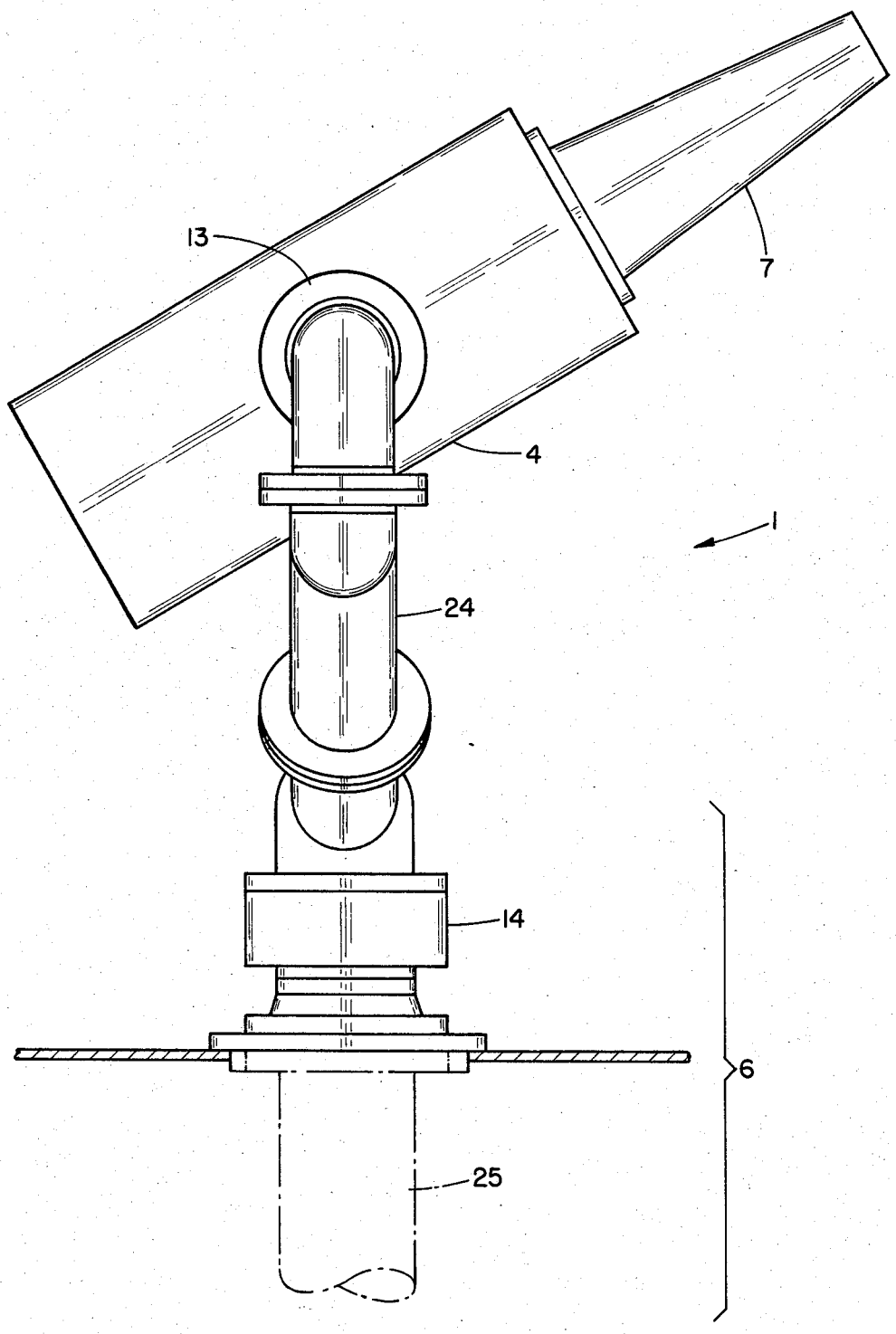
FIG. 3 is a side elevation view of the apparatus shown in FIG. 1.

As shown in FIGS. 1, 2 and 3, a fire monitor 1 is provided with water inlet means 6 comprising a vertical supply pipe 25 and a swivel 14 for horizontal adjustment of a water-jet issuing from the apparatus. Two branches 24 extend from the pipe 25 into opposite sides of an outer tubular part 4 forming a water conduit 4 and the branches 5 and are provided with swivels 13 for vertical adjustment of the jet issuing from the apparatus.

Water entering the outer tubular part 4 from the two branches 24,24 flows axially along the water conduit 4 and 5 past flow straightening vanes 10 and then passes around a semi-toroidal bend into an inner tubular part 5 forming the water conduit 4 and 5 before flowing through outlet nozzle 7. The reversal of flow is effected by flow deflectors comprising a baffle plate 8, which closes the rear end of the outer tubular part 4, and fairings 9 which are mounted on the axially adjacent end of the inner tubular part 5 of the water conduit 4 and 5. As shown in FIG. 2, the baffle plate 8 has an outer peripheral portion 12 which is curved so as to cooperate with the fairing 9 so as to reduce swirl and turbulence of the water flowing therethrough.

In addition to the elongation of the flow path of water through the conduit 4 and 5 by means of the compact arrangement provided by the invention, turbulence and swirl in water fed to the outlet nozzle 7 are reduced to a very low level. Further reduction in swirl and turbulence is also obtained by the use of adjustable vanes 11 which are mounted in the innermost tubular part 5 of the water conduit 4 and 5. The adjustable vanes 11 can also be used to impart a controlled amount of swirl and turbulence to the jet issuing from the outlet nozzle 7 in order to control the characteristics of the water jet.

Figure 4:
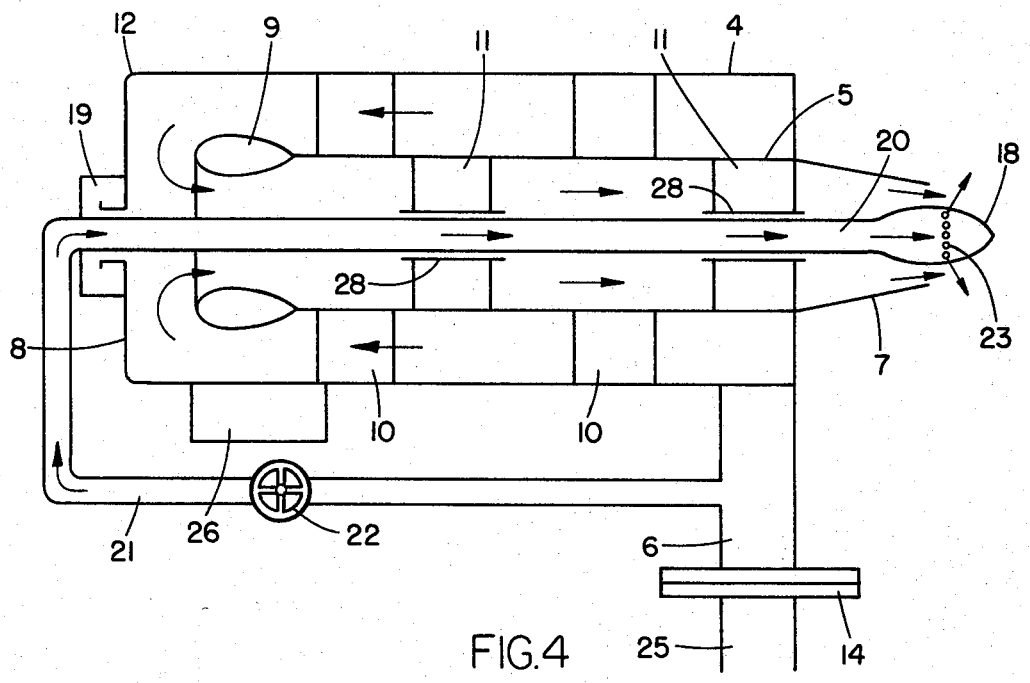
FIG. 4 is a schematic sectional side elevation view of a second fire monitor embodying the present invention.

In the fire monitor 2 shown in FIG. 4, a further conduit 20, which is mounted in the innermost tubular part 5 of the water conduit 4 and 5 and supported at bearing 28 and control station 19, is communicatively connected to a hollow centre body 18 for controlling the size of the flow cross-section of the outlet nozzle 7.

The further conduit 20 is also connected to the inlet means 6 by means of a branch pipe 21 which is provided with a control valve 22 for varying the flow of water through outwardly directed outlet openings 23 in the centre body 18, so as to vary the characteristics of the water jet issuing from the outlet nozzle 7.

This flow may also be varied by control means 19 which can be operated to vary the longitudinal position of the centre body 18 relative to the outlet nozzle 7, as a result of non-uniform cross-section shape of the centre body 18.

As schematically shown in FIG. 4, the fire monitors 1 and 2 may also be provided with additive fluid inlet means 26 for injecting or inducing liquid or gas into the water passing through the water conduit 4 and 5. Depending on the design of the inlet means 26 and its location relative to the nozzle 7, this additive fluid can be used to disrupt the water jet.

Figure 5:
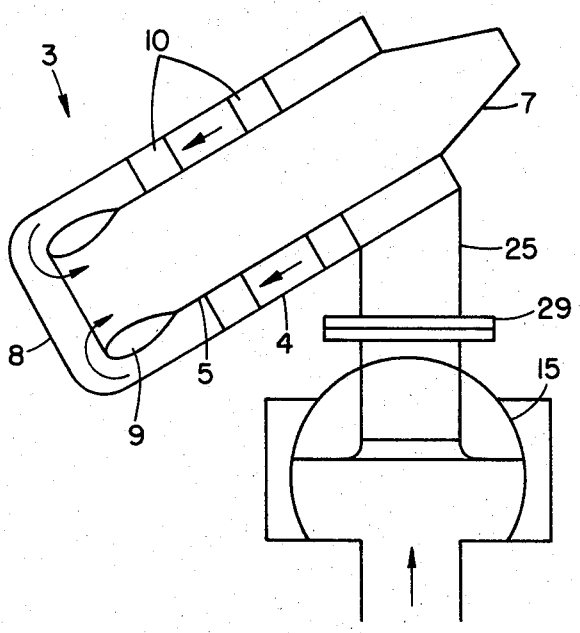
FIG. 5 is a schematic side elevation view of a third fire monitor embodying the invention.

In the fire monitor 3 shown in FIG. 5, the vertical supply pipe 25 is connected to a ball-and-socket joint 15 by a flange connection 29 for use in swivelling the apparatus, so as to control the direction of the jet issuing from the outlet nozzle 7.

Figure 6:
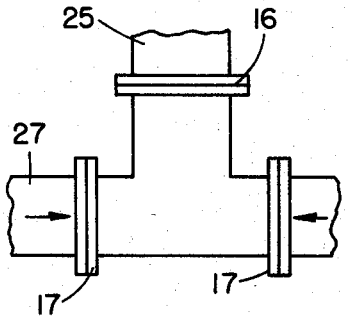
FIG. 6 is an end elevation view of part of a still further embodiment of the invention, similar to that shown in FIG. 5.

The fire monitor 3 shown in FIG. 5 may be modified as shown in FIG. 6. Here, the inlet means comprise a vertical supply pipe 25 provided with a swivel 16 for horizontal adjustment of the apparatus about a vertical axis. The pipe 25 has two horizontally extending inlet branches 27 which are provided with swivels 17 to allow the fire monitor to be adjusted about a horizontal axis.

I claim:

1. A fire monitor for projecting water comprising:

an outer tube having an upstream end communicating with water inlet means and a downstream and closed by a baffle plate;

an inner tube located radially within and coaxial with the outer tube, said inner tube having an open end located adjacent to and spaced from said baffle plate;

an outlet nozzle connected to a downstream end of said inner tube and extending coaxially therefrom;

said inner tube having an outer surface which is substantially constant in diameter, and said outer tube having an inner surface which is substantially constant in diameter and is spaced from said outer surface of said inner tube thereby defining a channel therebetween, whereby water flows from said inlet means through said channel, strikes said baffle plate and is deflected into said open end of said inner tube to flow towards said outlet nozzle;

said inner tube having an inner surface and said open end of said inner tube is rounded to provide a continuous surface between said inner and outer surfaces of said inner tube;

said inner surface of said inner tube having a continuous surface defined by a gradual increase in the cross-section of said inner tube from said rounded open end over a portion of said predetermined length and a gradual decrease in cross-section for the remainder of said predetermined length;

said baffle plate having a surface which faces said open end of said inner tube, said facing surfaces having a curved periphery corresponding to the rounded open end of said inner tube and a continuous flat surface extending over the entire remaining area of said facing surface, whereby a semi-toroidal bend is provided at said downstream end of said outer tube and said open end of said inner tube to minimize turbulence in the water flow from said channel into said inner tube;

and said outer tube has an outer surface which has a substantially constant diameter to permit said outlet nozzle to be deflected through a wide range of angles without obstruction.

2. A fire monitor as claimed in claim 1, further comprising swivel mounting means mounted between said inlet means and said outer tube, so as to allow movement of said outer tube about its horizontal and vertical axes.

3. A fire monitor as claimed in claim 1, wherein said inlet means include two coaxially aligned horizontal branches extending in opposite directions, and further comprising swivel mounting means in said horizontal branches permitting adjustment of the axis of said outer tube about a horizontal axis.

* * * * *